US007530399B2

(12) United States Patent
Dreelan

(10) Patent No.: US 7,530,399 B2
(45) Date of Patent: May 12, 2009

(54) DELIVERY SYSTEM FOR DOWNHOLE USE

(75) Inventor: Michael Joseph Dreelan, Portlethen (GB)

(73) Assignee: Qserv Limited, Aberdeen (GB)

( * ) Notice: Subject to any disclaimer, the term of this patent is extended or adjusted under 35 U.S.C. 154(b) by 158 days.

(21) Appl. No.: 11/591,357

(22) Filed: Nov. 1, 2006

(65) Prior Publication Data

US 2007/0107900 A1 May 17, 2007

(30) Foreign Application Priority Data

Nov. 11, 2005 (GB) ..... 0522971.1

(51) Int. Cl.
*E21B 19/09* (2006.01)

(52) U.S. Cl. ..... 166/355; 166/352; 405/195.1

(58) Field of Classification Search ..... 166/355, 166/350–352, 367; 405/158, 195.1, 196, 405/168.3

See application file for complete search history.

(56) References Cited

U.S. PATENT DOCUMENTS 5,660,235 A * 8/1997 Sola ..... 166/384
6,000,480 A * 12/1999 Eik ..... 175/8
6,817,422 B2 * 11/2004 Jordan ..... 166/381
7,165,619 B2 * 1/2007 Fox et al. ..... 166/343
7,226,244 B1 * 6/2007 De Groot et al. ..... 405/168.4
7,284,618 B2 * 10/2007 Geddes et al. ..... 166/384
2006/0000619 A1 * 1/2006 Borst et al. ..... 166/384
2007/0089882 A1 * 4/2007 Patton et al. ..... 166/353

FOREIGN PATENT DOCUMENTS

GB 2 343 466 5/2000

* cited by examiner

*Primary Examiner*—Thomas A Beach
*Assistant Examiner*—Matthew R Buck
(74) *Attorney, Agent, or Firm*—Drinker Biddle & Reath LLP

(57) ABSTRACT

A delivery system for downhole use comprising an elongate delivery member, such as a length of wireline cable or coiled tubing, an injector to control the insertion of the delivery member into the well, and a storage device such as a reel to store at least a portion of the delivery member prior to insertion into the well. The system has a motion compensator arranged to compensate for relative motion between the injector and the storage device. The motion compensator optionally is arranged to compensate for relative movement between the injector and the well, and the movement of the motion compensator on the storage device and the motion compensator on the injection head can be coordinated by a motion controller adapted and arranged to measure the movement of the injector and to signal the motion compensator on the storage device to move in accordance with the movement of the injector.

18 Claims, 3 Drawing Sheets

Fig. 4
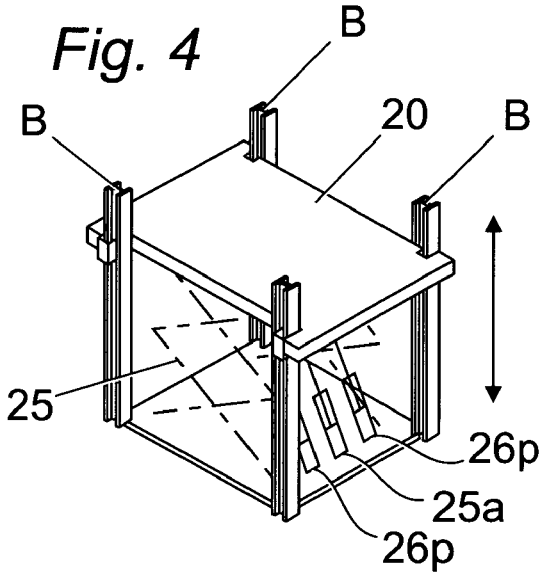
Fig. 5
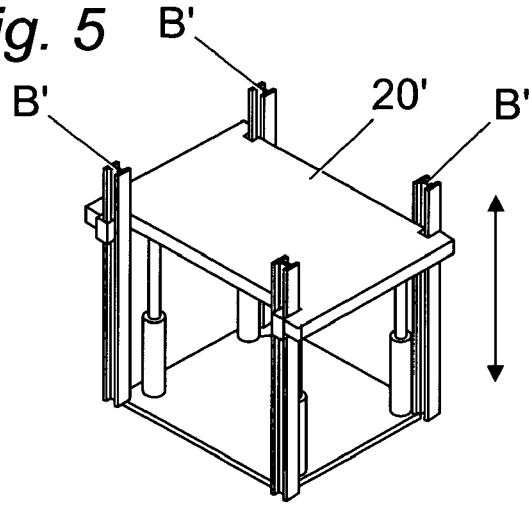
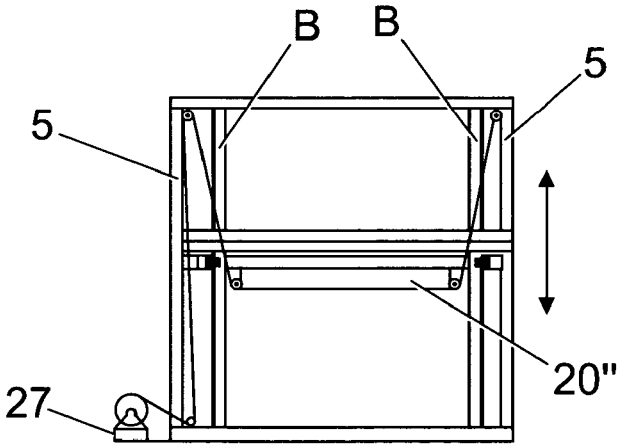
Fig. 6
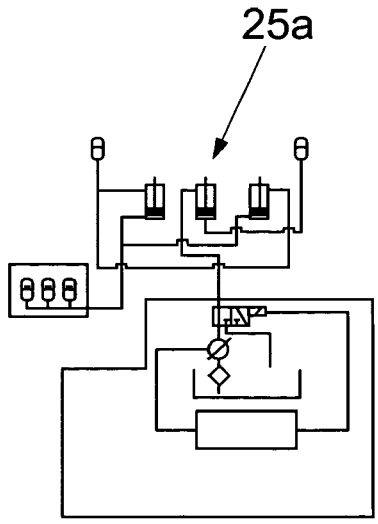
Fig. 7

DELIVERY SYSTEM FOR DOWNHOLE USE

FIELD OF THE INVENTION

The present invention relates to a motion compensator apparatus for use on an oil or gas well, for controlling the motion of an elongate member stored on a coil or reel. The invention also relates to a method of its use.

BACKGROUND OF THE INVENTION

Semi-submersible rigs and other vessels such as FPSOs are commonly used for the recovery of oil or gas, and are typically anchored to the seabed at the surface of the sea, above the oil or gas well, so that they can access the well through elongate tubing, risers or casing etc. Naturally, the floor of the rig heaves with the motion of the sea, whereas the casing or riser etc is fixed immovably to the wellhead on the seabed. This creates relative movement between the rig floor and the equipment inserted into the well, which is generally accommodated by heave compensators of known design.

When well intervention operations are carried out from such a vessel, the operator must insert the intervention tool into the outer casing at the rig floor, and then manipulate the tooling using the chosen delivery system (normally coiled tubing or wireline) towards the correct target. Since the intervention tool is connected between the heaving rig and the static well, the delivery system of coiled tubing or wireline delivery system is subject to cyclic movement, which is generally accommodated by a motion compensator on the derrick at the point where the wireline or coiled tubing is grasped and inserted into the well.

When the intervention tool delivery system is very long (such as coiled tubing or wireline delivery systems) the reel or other storage device for the elongate portion to be inserted into the well is generally stored on the rig floor, and problems have arisen when the reel of coiled tubing or wireline cable is moving cyclically relative to the compensated injector head.

BRIEF SUMMARY OF THE INVENTION

According to the invention there is provided a motion compensator for a storage device on a downhole tool delivery system.

The invention also comprises a delivery system for downhole use, the delivery system comprising an elongate delivery member, an injector to control the insertion of the delivery member into the well, and a storage device to store at least a portion of the delivery member prior to insertion into the well, the system having a motion compensator arranged to compensate for relative motion between the injector and the storage device.

The invention also provides a method of inserting an elongate member into a well, wherein an injector controls the insertion of the delivery member into the well, and a storage device stores at least a portion of the delivery member prior to insertion into the well, the method including the step of compensating for the relative motion between the injector and the storage device.

The injector can comprise an arcuate guide device for guiding the elongate member into the well. A suitable arcuate guide device can comprise a static gooseneck or a rotating sheave. The injector can simply consist of the guide device alone, but in some embodiments, a stuffing box and/or a clutch can be included in the injector.

The delivery system can be adapted for connection to any kind of downhole device such as a bit or a reamer etc or to logging tools or sensors. The type of downhole device is not a limiting factor in the scope of the invention. Alternatively, the delivery system can be used without delivering any kind of downhole device at all, and is suitable for delivery of fluids or downhole compositions to a target area.

The delivery system may have a separate motion compensator arranged to compensate for relative movement between the injector and the well, and in that event, the movement of the motion compensator on the storage device and the motion compensator on the injection head are coordinated by a motion controller.

The motion controller can be a linear transducer such as a radar or ultrasonic or laser measurement device, adapted and arranged to measure the movement of the injector and to signal the motion compensator on the storage device to move in accordance with the movement of the injector. An accelerometer can alternatively be used to measure movement of the injector head and report to the control system of the motion compensator for the reel. Any other type of movement or distance sensor can be used instead. In one preferred embodiment, the motion controller can comprise a linear transducer (typically mounted on base of the frame of the injector head) and a motion reference unit, such as an accelerometer, located on the drill floor. The accelerometer is typically predictive, assisting the control system to react quickly enough to maintain between the motion compensator systems, whereas the linear transducer confirms the actual position of the injector head relative to a fixed point on the rig. The control system uses feedback from both of these instruments to fine tune synchronization in real time.

The storage device can optionally be a reel and the elongate member can be wireline or coiled tubing, or any other deployment system for insertion of downhole tools into a well. The reel is typically located on the deck of a floating rig or other vessel such as an FPSO. The reel is typically supported by one or more hydraulically movable arms, and in some embodiments is disposed on a frame or platform that is so supported.

In some simple embodiments, it is sufficient for a rectilinear platform or table to be supported at each corner by a separate hydraulic cylinder that can move independently of the others. In this way, the platform can be raised or lowered in the vertical plane in concert with the injector head. More complex movement of the platform in other planes can be achieved very easily with such as system. The hydraulic cylinders can be positioned directly under each of the corners in a vertical arrangement, or can be disposed across the vertical axis in some way, so that they extend and contract on an axis that is not parallel to the vertical axis. In other embodiments, the hydraulic cylinders can drive the extension of other supporting arms instead of bearing directly on the platform, and these arms are typically provided with one fixed end pivotally mounted on the frame, and one sliding end on the platform. In some embodiments, the arms can be provided in scissor arrangements, with pivotal interconnections between two or more arms.

In certain embodiments, motion dampers can be provided to control the motion of the storage device in a certain circumstances. For example, only some of the hydraulic cylinders can be used to drive the movement of the frame, and these are usually powered by a hydraulic pump and are driven and retracted actively to move the frame in accordance with the movement of the injector head. In some embodiments, other cylinders can act as passive or active dampers to restrict movement of the frame in the absence of power to the powered cylinders.

Hydraulic devices are not necessary and in some embodiments, the platform can be supported by ropes controlled by winches that are in turn controlled by signals generated by motion of the injector.

The effect of this motion compensator between the storage device and the injector is to hold the two stationary relative to one another during insertion of the elongate member into the well. This is especially useful when the insertion of the elongate member is paused for any reason, for example, to free stuck tubing or negotiate an obstacle, or when the downhole target has been reached. The compensation between the storage device and the injector prevents or reduces the cyclic movement between the two that could lead to premature wear or failure of the elongate member.

BRIEF DESCRIPTION OF SEVERAL VIEWS OF THE DRAWINGS

Embodiments of the present invention will now be described by way of example, and with reference to the accompanying drawings, in which:

FIG. 4 is a perspective view of the FIG. 3 motion compensator;

FIG. 5 is a perspective view of a second example of a motion compensator for a storage device;

FIG. 6 is an perspective view of a third example of a motion compensator for a storage device; and FIG. 7 is a schematic view of a control system for the FIG. 4 motion compensator.

DETAILED DESCRIPTION OF THE INVENTION

Figure 1:
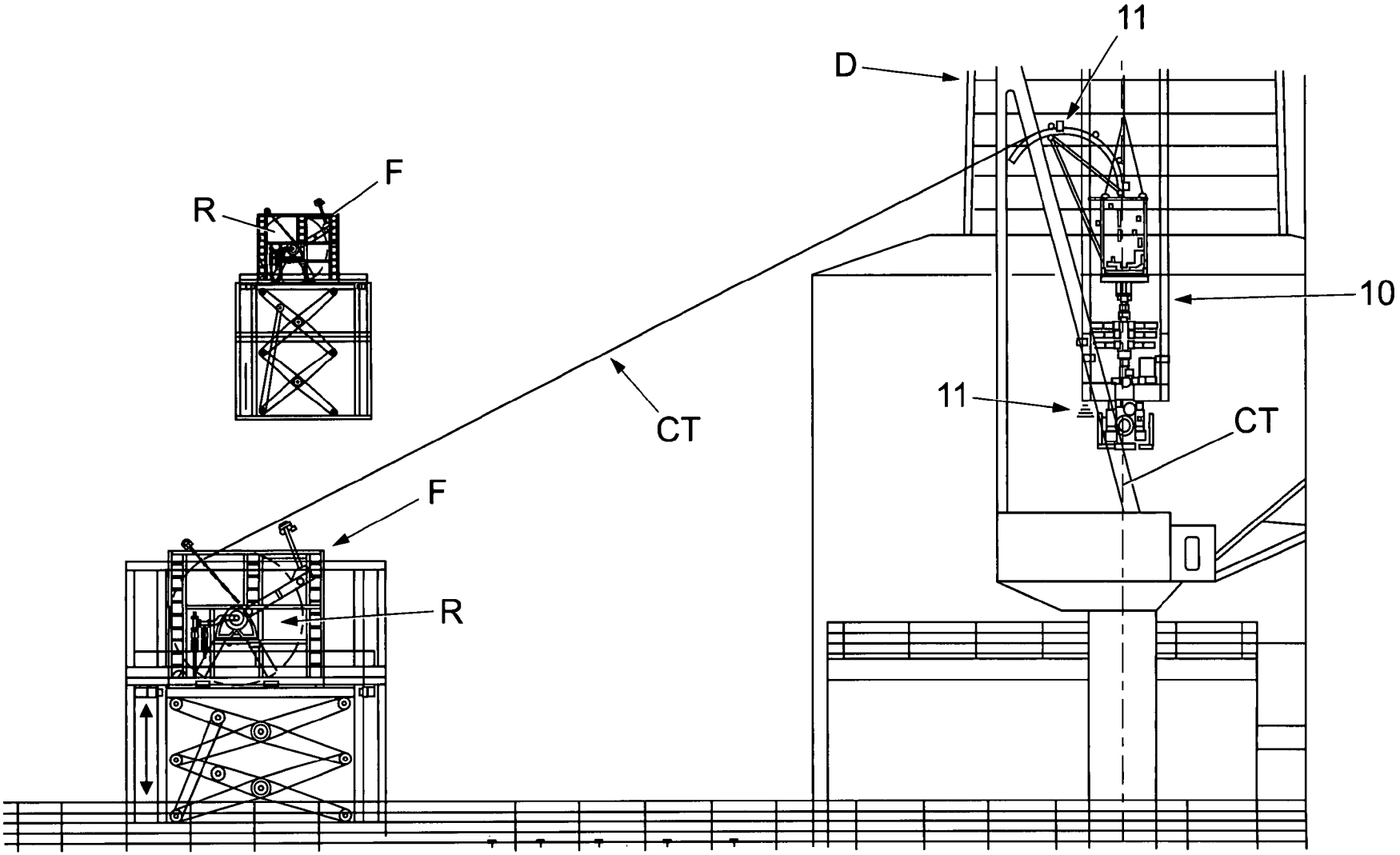
FIG. 1 is a side view of a coiled tubing injector system used to deploy a downhole device such as a logging tool.

Referring now to the drawings, FIG. 1 shows a side view of an overall coiled tubing system embodying a motion compensation system in accordance with the present invention. In the FIG. 1 system, coiled tubing CT is spooled from a reel R that is journalled on a frame F. Coiled tubing CT is injected into a hole by a coiled tubing injector head 10 that is mounted on a derrick D. The coiled tubing injector head 10 has a gooseneck 11 to control and support the bend of the coiled tubing CT as it enters the injector head 10. Below the injector head 10, the coiled tubing CT is injected vertically into the hole. The system described and shown in FIG. 1 is mounted on a semi-submersible rig, but the principles are applicable to any floating installation or vessel.

The coiled tubing injector head 10 has a motion compensation system (not shown) to compensate for relevant movement between the injector head 10 connected to the moving rig, and the stationary well, so that the coiled tubing CT leaving the lower end of the injector head 10 and being inserted into the well is generally held stationary relative to the well, but is in motion relative to the derrick D and the rig floor. The cyclic flexing of the tubing typically causes premature fatigue and failure of the tubing. The cyclical heave motion is experienced by the entire rig because of the motion of the sea. This generally poses little difficulty during insertion of the coiled tubing CT, but when the insertion process is paused for any reason, for example in order to negotiate an obstruction in the well, or when the coiled tubing CT has reached its target depth, the cyclical movement of the injector head 10 relative to the coiled tubing CT yet to be inserted into the injector head repeatedly flexes the coiled tubing CT in the region of the gooseneck 11, and as it is leaving the reel R. This cyclic flexing of the coiled tubing CT causes extensive wear on the areas being repeatedly bent and straightened, and makes these areas prone to failure. In order to avoid this problem, the FIG. 1 system employs a motion compensator associated with the reel R in order to move the reel in concert with the injector head 10, thereby compensating for any relevant movement between the reel R and the head 10, and removing the flexing of the coiled tubing in the intermediate areas.

Figure 2:
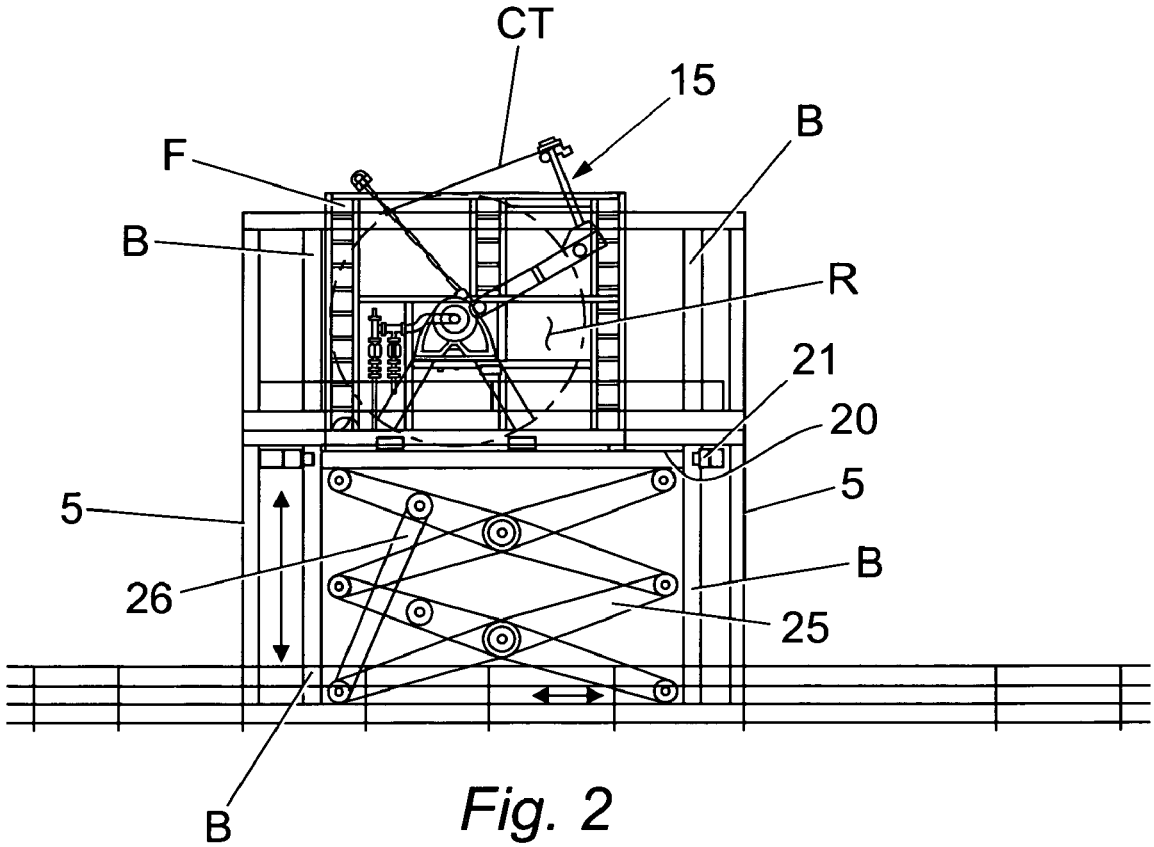
FIG. 2 is an expanded view of the motion compensator on the storage device of the FIG. 1 system, in a first configuration.

Referring now to FIG. 2, the coiled tubing reel R is journalled on bearings in the frame F in order to allow spooling of the coiled tubing CT from the reel R during injection. The reel R is driven relative to the frame F in order to apply tension to the coiled tubing CT between the reel R and the injector head 10, i.e. anti-clockwise with respect to FIG. 2. The frame F has a spooling guide 15 to guide the coiled tubing CT from the reel R. The frame F bearing the reel R is mounted on a platform 20 which is connected via rollers 21 to four vertical beams B disposed at respective corners of the platform 20. The beams B are supported by an outer frame 5 in a rigid manner.

The platform 20 can slide on the beams B in a vertical plane, in order to raise and lower the reel R within the outer frame 5. In order to drive this movement, the platform 20 is supported from below by at least one expanding scissor mechanism 25 made up of interconnected scissor arms pivotally connected at respective ends to the platform and the rig floor, and at their mid points to one another. The movement of the scissor mechanism 25 is driven by a hydraulic cylinder 26, which is connected between respective ends of at least one of the pairs of scissor arms.

Figure 3:
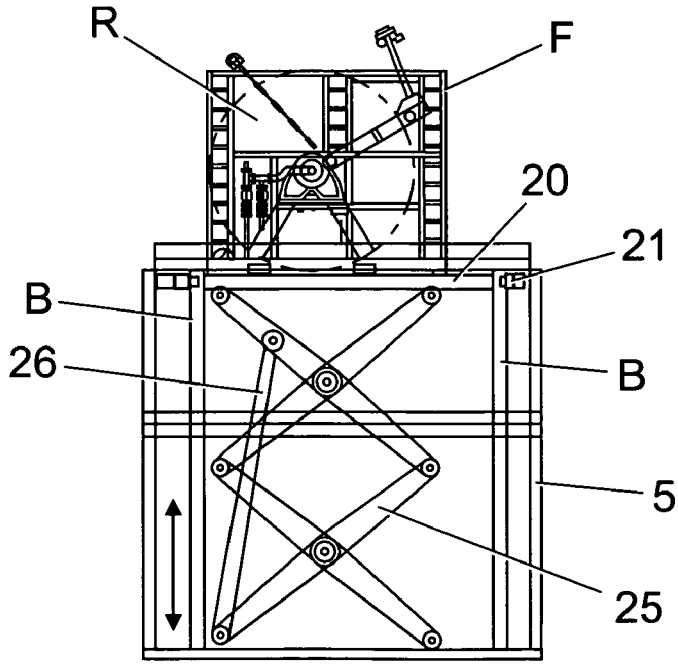
FIG. 3 is an expanded view of the motion compensator on the storage device of the FIG. 1 system, in a second configuration.

When the hydraulic cylinder 26 is in its retracted position, the scissor mechanism 25 is retracted as shown in FIG. 2, and the platform 20 is in its lowest configuration within the frame 5. When the hydraulic cylinder 26 is extended as shown in FIG. 3, the scissor mechanism 25 is also extended, which raises the platform 20 and the reel R, while keeping the platform level and perpendicular to the beams B. The hydraulic cylinder 26 is powered by a hydraulic pump (not shown), and controlled by a control circuit, which governs its extension and retraction, and thereby controls the height of the platform 20 above the rig floor.

FIG. 4 shows a perspective schematic view of three such scissor mechanisms controlling the movement of the platform 20. In the FIG. 4 embodiment, the central cylinder 25*a* controlling the central scissor mechanism 25 is a powered cylinder connected to the hydraulic pump, whereas the outer cylinders 26*p* are passive cylinders acting as dampers. The passive cylinders can be used to set the platform in a floating state at full extension, with the platform loaded. This typically reduces the energy required (i.e. the pressure and volume of hydraulic fluid) by the active system to retract the platform so that it is moving in sync with the rig. The charge pressure of the passive system is optionally monitored and controlled by the control system, possibly in line with feedback from load cells mounted between the reel and the reel platform. This is helpful because as the CT is spooled from the reel, the reel gets lighter, and therefore less pressure is required in the passive system. The opposite situation pertains as the reel spools in.

In the FIG. 5 embodiment, the hydraulic cylinders are provided at respective corners of the platform 20', and typically all of the hydraulic cylinders are powered by the hydraulic pump. In most circumstances, an active/passive system would be utilized, with four cylinders charged by the passive system, with possibly an additional two being charged by an active system, i.e. retracting the platform 20 as required to remain in sync with the rig.

In the FIG. 6 embodiment, the hydraulic cylinders are omitted, and the platform 20" is suspended via ropes and pulleys, and is raised and lowered by means of a hydraulic winch 27.

In each of these embodiments, the control system for the motion compensator on the reel R is typically controlled by feedback signals from a linear transducer mounted on the coiled tubing injector head 10 and an accelerometer. The linear transducer in this embodiment is in the form of a laser measurement device 11, which measures the distance (as a function of time) between the coiled tubing injector head 10, and the rig floor, but a mechanical transducer can be used instead or as well. These signals are relayed to the control system governing the motion of the hydraulic cylinder or pump. In accordance with the signals received from the laser transducer 11, the control system of the motion compensator on the reel R moves the active cylinder 25*a* etc in and out in order to raise and lower the height of the platform 20 above the deck. This motion is coordinated with the motion of the coiled tubing injector head 10, so that the reel R and the head 10 both move together, and relative movement between them is effectively cancelled out. Therefore, the coiled tubing CT does not suffer any adverse forces as a result of the heave motion of the vessel.

Modifications and improvements can be incorporated without departing from the scope of the invention. For example, the platform can be arranged to move in the vertical plane only, or in more than one plane, for example the platform can be signaled to tilt or move laterally in some embodiments.

The invention claimed is:

1. A delivery system, adapted to be mounted on a floating vessel, the delivery system comprising an elongate delivery member for downhole use in a well, an injector to control the insertion of the delivery member into the well, and a storage device to store at least a portion of the delivery member prior to insertion into the well, the system having a first motion compensator acting on the storage device and arranged to compensate for heave-related relative motion between the injector and the storage device, and a separate, second motion compensator acting on the injector and arranged to compensate for heave-related relative movement between the floating vessel and the well, wherein the delivery system further includes a motion controller, and wherein the movement of the motion compensator on the storage device and the movement of the motion compensator on the injector are coordinated by the motion controller.

2. A delivery system as claimed in claim 1, wherein the motion controller comprises a linear transducer.

3. A delivery system as claimed in claim 2, wherein the linear transducer is selected from the group consisting of a radar device, an ultrasonic device, an accelerometer, and a laser measurement device.

4. A delivery system as claimed in claim 3, wherein the motion controller comprises a motion reference unit in addition to a linear transducer, and integrates signals from each.

5. A delivery system as claimed in claim 4, wherein the motion reference unit comprises an accelerometer.

6. A delivery system as claimed in claim 1, wherein the storage device comprises a reel and wherein the elongate member is wound onto the reel.

7. A delivery system as claimed in claim 1, wherein the storage device is supported by at least one hydraulically movable device.

8. A delivery system as claimed in claim 7, wherein the storage device is disposed on a platform supported at intervals around its circumference by hydraulic cylinders.

9. A delivery system as claimed in claim 8 wherein the hydraulic cylinders can move independently of each other.

10. A delivery system as claimed in claim 8, wherein the platform moves on a vertical axis, wherein the platform has at least two corners, and wherein hydraulic cylinders are positioned under each of the corners in a vertical arrangement.

11. A delivery system as claimed in claim 8, wherein the platform moves on a vertical axis, and wherein at least one of the hydraulic cylinders is disposed across the vertical axis.

12. A delivery system, comprising an elongate delivery member for downhole use in a well, an injector to control the insertion of the delivery member into the well, and a storage device to store at least a portion of the delivery member prior to insertion into the well, the system having a motion compensator arranged to compensate for relative motion between the injector and the storage device, wherein the storage device is supported by at least one hydraulically movable device, wherein the storage device is supported by at least one extendable supporting arm, and wherein the hydraulically movable device drives the extension of the supporting arm.

13. A delivery system as claimed in claim 12, wherein the supporting arm has one fixed end pivotally mounted on the frame, and one end that is slidably connected to the storage device.

14. A delivery system as claimed in claim 13, wherein two supporting arms are interconnected at pivot points.

15. A delivery system, comprising an elongate delivery member for downhole use in a well, an injector to control the insertion of the delivery member into the well, and a storage device to store at least a portion of the delivery member prior to insertion into the well, the system having a motion compensator arranged to compensate for relative motion between the injector and the storage device, wherein the storage device is supported by ropes controlled by winches that are controlled by signals generated by relative motion of the injector and the storage device.

16. A delivery system as claimed in claim 1, incorporating motion dampers to control the motion of the storage device.

17. A method of inserting an elongate member into a well from a floating installation or vessel, wherein an injector controls the insertion of the delivery member into the well, and a storage device stores at least a portion of the delivery member prior to insertion into the well, the method including compensating for relative motion between the injector and the storage device associated with heave experienced by the floating installation or vessel, compensating for relative motion between the floating vessel and the well, and coordinating the movement of the storage device and the injector.

18. A method as claimed in claim 17, wherein the elongate member is used for the delivery of fluids to the well.

* * * * *